United States Patent [19]

Shibata

[11] Patent Number: 4,695,330

[45] Date of Patent: Sep. 22, 1987

[54] METHOD OF MANUFACTURING INTERNAL OXIDIZED AG-SNO SYSTEM ALLOY CONTACT MATERIALS

[75] Inventor: Akira Shibata, Yokohama, Japan

[73] Assignee: Chugai Denki Kogyo K.K., Japan

[21] Appl. No.: 913,196

[22] Filed: Sep. 30, 1986

Related U.S. Application Data

[62] Division of Ser. No. 771,341, Aug. 30, 1985, Pat. No. 4,647,322.

[51] Int. Cl.[4] ..... C23C 8/10

[52] U.S. Cl. ..... 148/6.3; 29/874; 200/266

[58] Field of Search ..... 200/266; 148/6.3, 430, 148/431; 420/501-506; 429/929

[56] References Cited

U.S. PATENT DOCUMENTS 2,899,345 8/1959 Oshry ..... 148/6.35

*Primary Examiner*—Sam Silverberg

*Attorney, Agent, or Firm*—Schlesinger, Fitzsimmons & Shlesinger

[57] ABSTRACT

Internal oxidized Ag-SnO system alloy electrical contact materials having a moderate initial contact resistance and having no depletion layer is disclosed. The alloy is internal oxidized by having it sandwiched between pure silver thin layers, and is cut horizontally right in two, simultaneously removing the depletion layer from the internally oxidized alloy.

5 Claims, No Drawings

METHOD OF MANUFACTURING INTERNAL OXIDIZED AG-SNO SYSTEM ALLOY CONTACT MATERIALS

This application is a division of my pending U.S. patent application Ser. No. 771,341 filed Aug. 30, 1985 now U.S. Pat. No. 4647322 for Internal Oxidized Ag-SnO Sytem Alloy Contact Materials, And Manufacturing Method Thereof.

BACKGROUND OF THE INVENTION

Lately, Ag alloys which contain 0.5 to 12 weight % of Sn and which have been internal oxidized, are widely used as electrical contact materials in various electrical devices such as switches, contactors, relays and circuit breakers. Typical constituent of such Ag alloys are those comprising of Ag matrices, 0.5–12 weight % of Sn, and 0.5–15 weight % of In, and those comprising of Ag matrices, 3–12 weight % of Sn, and 0.01—less than 1.5 weight % of Bi. Said constituents may contain one or more metallic elements selected from 0.1–5 weight % of Cd, 0.1–2 weight % of Zn, 0.1–2 weight % of Sb, and 0.01–2 weight % of Pb. In the case of the above-mentioned latter constituents, 0.1—less than 2 weight % of In many be contained.

These Ag alloys which are generally in the form of thin plates with or without backing thin pure Ag plates joined to a side of the Ag alloy thin plates, are internally oxidized by subjecting them to an oxygen atmosphere under a pressure. Oxygen which has penetrated into the Ag alloys as time passes, oxidizes metallic solute elements in the alloys and precipitates them as minute metallic oxide distributed in their Ag matrices. Said metallic oxidized precipitates afford refractoriness and consequently anti-welding to the Ag alloys. The backing thin pure Ag plates work as mediums for brazing the oxidized Ag alloy contact materials to support or base metals of electrical contacts.

It has been observed, however, that when Ag alloys of the above-mentioned kind are internal oxidized, metallic solute elements in the Ag alloys do not precipitate and distribute evenly in their Ag matrices, but they tend to precipitate at a high concentration about outer areas which are not covered by pure Ag layers but are subjected directly to oxygen. Such precipitation of metallic oxides at outer areas produces their segregations about the outer areas, particularly at top surfaces, and bring in turn depletion layers of an unnegligible thickness which lie between the top and bottom surfaces of the Ag alloys. The segregations of metallic oxides at a high concentration about outer surfaces of electrical contact materials make the outer surfaces physically too hard, and produce electrically a high contact resistance of the materials especially at an initial stage of operations and consequently an excessive temperature raise. In practice, such segregations about the outer areas are shaved off by files and so on. This is not only laborious, but also it makes difficult to reuse filings of the outer areas, since they are contaminated by filings of the files.

In order to avoid the production of such segregations, there were invented by the present inventor certain methods such as disclosed in U.S. Pat. No. 4,457,787 in which vacant lattice voids are produced in Ag alloys by having them absorved with hydrogen and the like, and in the course of internal oxidation, solute metals fill in the voids and precipitate as oxides at the innumerable oxide nuclei on an atomic scale, without diffusing about much but only to such extent that they reach most adjacent voids, and consequently without any segregation and depletion thereof, and U.S. Pat. No. 4,472,211 in which a high contact resistance which is caused by high concentration or supersaturation of metal oxides including tin oxides about a contact surface, is avoided by having solute metals sublimated, reduced or extracted about the contact surface before the internal oxidation thereof.

The aforementioned depletion layers in which metallic oxides lack completely or they are extremely thin, can hardly stand up to severe switching operations, since they have poor refractoriness. Therefore, when a contact material having a depletion layer between its upper contact surface and lower surface is used till its wear reaches the depletion layer, its life ends. This means that while the lower half of the contact material which lies below the depletion layer can join with the upper half above the depletion layer to disperse heat generated with switching operations and to give a desired height of the material, it can not be active as a contact surface. Often, the existence of such lower half of the contact material is meaningless.

This invention is, therefore, to provide internal oxidized Ag-SnO system alloy electrical contact materials having contact surfaces of a moderate initial contact resistance and having no depletion layer, and a method of manufacturing such excellent contact materials, not using such methods as disclosed in the above-mentioned U.S. Patents which methods are difficult to adequately control.

BRIEF SUMMARY OF THE INVENTION

In this invention, an Ag alloy comprising Ag, 0.5–12 weight % of Sn, and 0.5–15 weight % of In or 0.01—less than 1.5 weight % of Bi, which may be added by one or more metallic elements selected from 0.1–5 weight % of Cd, 0.1–2 weight % of Zn, 0.1–2 weight % of Sb, 0.01–2 weight % of Pb, and 0.1—less than 2 weight % of In, is prepared to a flat plate or disk having a height which is at least twice a desired final height and is added by a height of a depletion layer which is expected to be produced when the Ag-alloy is completely internal-oxidized. Said Ag-alloy is backed at its both surfaces by thin pure Ag layers.

Then, the thus prepared Ag-alloy is completely internal oxidized in an oxygen atmosphere under a pressure and at an elevated temperature.

During the internal oxidation of the Ag-alloy, the backing thin pure Ag layers work as follows.

Since the partial pressure of oxygen, which has been dissolved into silver at the elevated temperature, is comparatively low, and since an amount of oxygen which diffuses through the silver is constant at a predetermined specific temperature, and under an oxygen atmosphere of a predetermined specific pressure, an amount of oxygen which shall be diffused into a metal alloy via the silver for oxidizing the former, can readily and freely be controlled. In addition to this advantage, since the oxygen in this instance is diffused into the metal alloy through the silver, and consequently at a selected direction of paths of oxygen, crystalline metallic grains oxidized and precipitated in the metal alloy are not arranged at random but can be prismatically aligned in the paths of oxygen. Since these prismatically aligned metallic oxides are also in parallel with electric current path passing through the internal oxidized Ag alloy contact material, electric resistance by the material is lowered.

The completely internal oxidized Ag alloy plate or disk having a depletion layer which lies centrally and transversely to the axis or height of plate or disk, is cut along said depletion layer by a super hard and high speed cutting device such as a mill with a width more than the width of the depletion layer. Unlikely to the conventional sanding off of segregation of metal oxides from outer surfaces of oxidized Ag alloys, said cutting operation does not give any contamination to cut surfaces and a cut-off portion of the Ag alloy which includes the depletion layer.

Two parts thus cut off from the plate or disk have respectively a completely internal oxidized Ag alloy body having a fresh contact surface of a moderate hardness and initial resistance and a pure silver backing at its bottom surface, and having no depletion layer.

DETAILED DESCRIPTION OF THE INVENTION

This invention is described below further in detail by way of examples.

EXAMPLES (1) Ag-Sn 8%-In 4%
(2) Ag-Sn 8%-In 4%-Cd 0.5%
(3) Ag-Sn 7%-Bi 0.5%
(4) Ag-Sn 7%-Bi 0.5%-Zn 0.3%

Alloys of the above (1) to (4) were melted in a high frequency melting furnace at about 1,100 to 1,200° C., and poured into a mold for obtaining ingots of about 5 Kg. Each ingot was stripped at its both surfaces. Then, each ingot was butted at its stripped both surfaces to pure silver plates by means of a hydroulic press, platens of which were heated at about 400° C., and rolled to a plate of 3.1 mm thicknes, while it was annealed at about 500° C. at every stages of rolling rates of 30% in reduction.

Each plate had one of the above alloys (1), (2), (3) and (4) of 2.5 mm thickness joined at its both surfaces by the pure silver layer of 0.3 mm thickness.

Each plate was completely internally oxidized in an oxygen atomosphere for 200 hours and at 650° C. The plate had centrally a depletion layer of about 0.1–0.2 mm thickness. Then, the plates were horizontally cut right in two by a mill with a kerf of 0.5 mm. And, the plates were slitted to obtain square electrical contacts of 5 mm sides and of a thickness of 1 mm, which were backed at one of the surfaces with a thin silver layer of 0.3 mm.

Instead of slitting the plates after the internal oxidation, they may be cut or pressed out to desired configurations before the internal oxidation.

In order to compare the above electrical contacts made in accordance with this invention, the following contacts were made.

(5) Ag-Sn 8%-In 4%
(6) Ag-Sn 8%-In 4%-Cd 0.5%
(7) Ag-Sn 7%-Bi 0.5%.
(8) Ag-Sn 7%-Bi 0.5%-Zn 0.3%

Similarly to the above examples, the above alloys (5) to (8) were prepared to ingots. Then, each ingot was butted at its stripped surface to a pure silver plate by means of a hydraulic press, platen of which was heated at about 440° C., and rolled to a plate of about 2 mm thickness, while it was annealed at about 600° C., at every stages of rolling rates of 30% in reduction.

Each plate was internally oxidized in an oxygen atmosphere for 200 hours and at 650° C. Then, internally oxidized plates were pressed by a punch of 6 mm in diameter to obtain electrical contacts of 2 mm in thickness which were backed with a thin silver layer.

The above contact samples of alloys (1) to (4) of this invention and of alloys (5) to (8) of prior known samples were checked of their contact surface hardness, and of their initial contact resistance with the following conditions.

Initial contact resistance:
Contact pressure—400 g
Current—DC 6 V, 1A

TABLE 1

| Samples | Hardness (HR "F") |
|---|---|
| (1) | 69–80 |
| (2) | 67–72 |
| (3) | 64–75 |
| (4) "of this invention" | 64–75 |
| (5) | 95–105 |
| (6) | 93–94 |
| (7) | 90–100 |
| (8) "of prior known samples" | 90–100 |

TABLE 2

| Samples | Initial contact resistance (mΩ) |
|---|---|
| (1) | 0.6–2.0 |
| (2) | 0.6–2.0 |
| (3) | 1.5–1.3 |
| (4) "of this invention" | 0.5–1.4 |
| (5) | 1.2–2.2 |
| (6) | 1.2–2.2 |
| (7) | 0.7–2.1 |
| (8) "of prior known samples" | 0.7–2.2 |

Thus, it is known from the aobve tables that the contact materials made in accordance with this invention have moderate hardness and lower initial contact resistance, compared to corresponding prior-known contact materials.

I claim:

1. A method of making internal oxidized Ag-SnO system alloy electrical contact materials which comprises preparing an Ag alloy layer having a thickness at least twice as thick as a desired thickness, wherein said alloy comprises 0.5–12 weight % of Sn, and a metal selected from the group consisting of In in a 0.5–15 weight percent and Bi in a 0.01 to less than 1.5 weight percent, sandwiching said alloy layer between pure thin silver layers, completely internally oxidizing said alloy layer to form a depleted layer which lies centrally and transversely to the axis or to the height of said alloy layer, and cutting said alloy layer along said depleted layer thereby removing said depleted layer.

2. A process according to claim 1, wherein said alloy comprises 0.01 to less than 1.5 weight % of Bi and further comprises at least one metal selected from the group consisting of 0.1–5 weight % of Cd, 0.1–2 weight percent of Zn, 0.1–2 weight % of Sb, 0.01–2 weight % of Pb and 0.1 to less than 2 weight % of In.

3. A process according to claim 1, wherein said alloy comprises 0.5–15 weight % of In and further comprises at least one metal selected from the group consisting of 0.1–5 weight % of Cd, 0.1–2 weight % of Zn, 0.1–2 weight % of Sb and 0.01–2 weight % of Pb.

4. The method as claimed in claim 1, in which the alloy is slitted to desired configurations after the internal oxidation.

5. The method as claimed in claim 1, in which the alloy is pressed or cut out to desired configurations before the internal oxidation.

* * * * *